US012310493B1

(12) United States Patent
Krayzel

(10) Patent No.: US 12,310,493 B1
(45) Date of Patent: May 27, 2025

(54) STRUCTURES WITH INCLINED PLANAR SUPPORTS

(71) Applicant: Michael James Krayzel, Titusville, FL (US)

(72) Inventor: Michael James Krayzel, Titusville, FL (US)

( * ) Notice: Subject to any disclaimer, the term of this patent is extended or adjusted under 35 U.S.C. 154(b) by 0 days.

(21) Appl. No.: 19/017,729

(22) Filed: Jan. 12, 2025

(51) Int. Cl.
*A47B 57/34* (2006.01)
*A47B 57/36* (2006.01)

(52) U.S. Cl.
CPC ..... *A47B 57/34* (2013.01); *A47B 57/36* (2013.01)

(58) Field of Classification Search
CPC ..... A47B 57/34; A47B 57/36; A47B 47/027; A47B 2230/0085; A47B 2230/0992; A47B 95/00; A47B 45/00; A47D 1/0085; F16B 12/12
USPC ..... 108/109, 108, 3, 92, 110, 193, 186, 149, 108/151, 157.13, 180, 156, 157.16, 108/157.18, 158.12; 211/90.02, 150, 193, 211/175, 90.01, 90.04, 87.01, 134, 153, 211/187, 103, 192, 191, 207, 204, 206; 248/235, 250, 241, 243
See application file for complete search history.

(56) References Cited

U.S. PATENT DOCUMENTS 947,140 A * 1/1910 Wolkstorfer
1,554,137 A * 9/1925 Slifkin ..... A47B 57/52 248/242
3,464,565 A * 9/1969 Nevai ..... A47B 47/00 211/186
D401,084 S * 11/1998 Martin ..... D6/675.3
6,132,129 A * 10/2000 Frazier ..... A47B 13/04 403/219
6,532,878 B2 * 3/2003 Tidemann ..... A47B 47/042 108/186
8,216,114 B1 * 7/2012 Wynn, III ..... A63B 23/0458 482/52
8,960,788 B2 * 2/2015 Chuah ..... A47D 1/004 297/151
9,332,838 B1 * 5/2016 Kilday ..... A47B 47/042
(Continued)

FOREIGN PATENT DOCUMENTS

CN 200970007 Y * 11/2007
DE 29704106 U1 * 7/1997 ..... A47B 47/042
(Continued)

OTHER PUBLICATIONS

DE29704106 English abtract (Year: 1997).*

*Primary Examiner* — Janet M Wilkens

(57) ABSTRACT

The disclosure relates to structures comprised of horizontal members joined to inclined longitudinal support members. To improve the lateral force resistance of the structure, the inclined support members are rotated along the longitudinal axis. Additionally, the inclined rotated support members include recesses or alternative fitments at desired levels along their length. Concertedly, the horizontal members contain elongated slots that are adapted in size, position, and angles of inclination to correspondingly engage the fitments, forming fastener-free compound joints supporting the horizontal members at the desired levels. This disclosure includes embodiments of wall-supported structures and free-standing structures that could serve various functions including shelving and other articles of furniture, stairs, and ladders.

14 Claims, 3 Drawing Sheets

(56) References Cited

U.S. PATENT DOCUMENTS

| | | | | |
|---|---|---|---|---|
| 2002/0178979 | A1* | 12/2002 | Tidemann | A47B 47/042<br>108/186 |
| 2003/0038514 | A1* | 2/2003 | Johnston | B60N 2/20<br>297/188.04 |
| 2004/0118792 | A1* | 6/2004 | Herring | A47B 43/00<br>211/195 |
| 2008/0023428 | A1* | 1/2008 | Mangano | A47B 96/061<br>211/193 |
| 2014/0217048 | A1* | 8/2014 | Wood | F16B 12/50<br>211/186 |
| 2015/0090682 | A1* | 4/2015 | Walker | A47B 95/00<br>211/183 |

FOREIGN PATENT DOCUMENTS

| | | | | |
|---|---|---|---|---|
| DE | 19824348 | A1 * | 4/1999 | A47B 47/0075 |
| DE | 202006000301 | U1 * | 6/2006 | A47B 47/042 |
| DE | 202012004500 | U1 * | 7/2012 | F16M 11/10 |
| DE | 102021108016 | A1 * | 10/2022 | |
| GB | 2141922 | A * | 1/1985 | F16M 11/242 |
| WO | WO-9505102 | A1 * | 2/1995 | A47B 13/04 |

* cited by examiner

STRUCTURES WITH INCLINED PLANAR SUPPORTS

PRIOR ART

U.S. Pat. No. 3,612,289 June 1969 Zink 211/148
U.S. Pat. No. 4,022,327 October 1975 Anderson 211/74
U.S. Pat. No. 6,532,878 March 2003 Tideman 108/186
U.S. Pat. No. 8,281,943 October 2012 Suman 211/150
U.S. Pat. No. 9,309,909 December 2016 Wood 211/186

BACKGROUND OF THE INVENTION

Well known in the prior art are structures comprised of horizontal planar members supported by spaced apart inclined planar support members. Often, fasteners and/or connectors are used to join the inclined support members to the horizontal members. For reasons including economy, aesthetics, and functionality, fastener-free structures which minimize the materials and complexity of such structures are contemplated. Generally, these structures, with or without fasteners, are stronger resisting top-down forces and front-to-back forces, than resisting lateral forces. It is the aim of this invention to improve the lateral force resistance of structures with inclined planar support members while minimizing the number of components and overall materials.

SUMMARY OF THE INVENTION

This invention improves upon the existing art by featuring inclined longitudinal planar support members that are rotated obliquely along the longitudinal axis, thereby increasing the lateral force resistance of the assembled structure. Recesses or other suitable fitments on the support members slidably and detachably engage with correspondingly adapted angled slots in the horizontal members forming compound angular joints of the horizontal members and support members without the need for additional connectors or fasteners. The compounded triangular force resistance that results from the compound angular joints improves the resistance of the structure against lateral forces, thereby improving its overall strength and stability over structures not featuring inclined rotated support members.

DETAILED DESCRIPTION OF THE INVENTION

Figure 1:
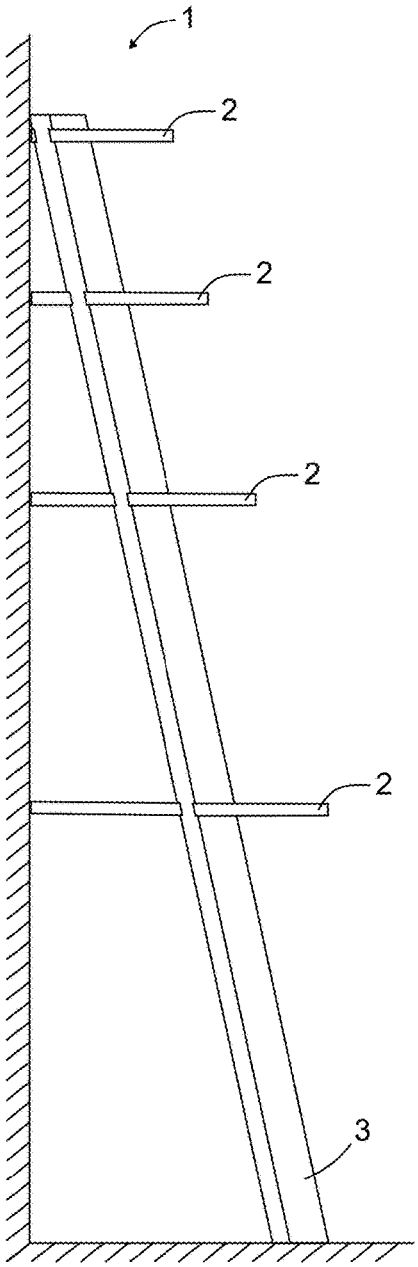
FIGS. 1, 1A are side and perspective views of a shelving structure embodying the present invention with inclined obliquely rotated support members engaging the ends of the shelves.
Figure 1A:
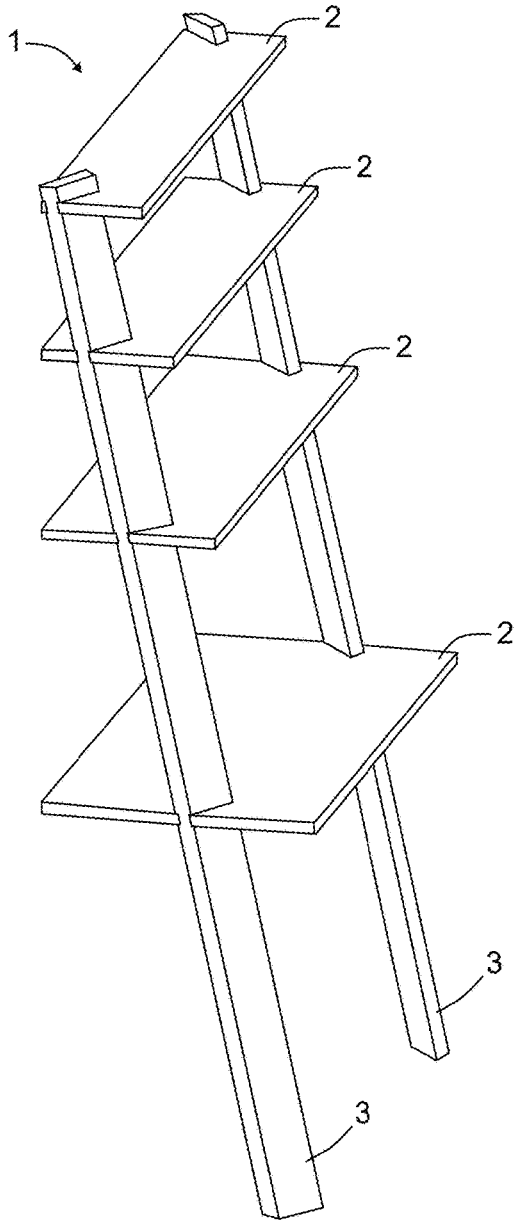

FIG. 1 and FIG. 1A illustrate a structure 1 such as a shelving structure, embodying the present disclosure. In this illustrated embodiment, structure 1 includes a plurality of horizontal planar members 2 to be referred to as "shelves", and a pair of inclined planar supports members 3 to be referred to as "legs" positioned one each at the opposite ends of the shelves 2.

Figure 2:
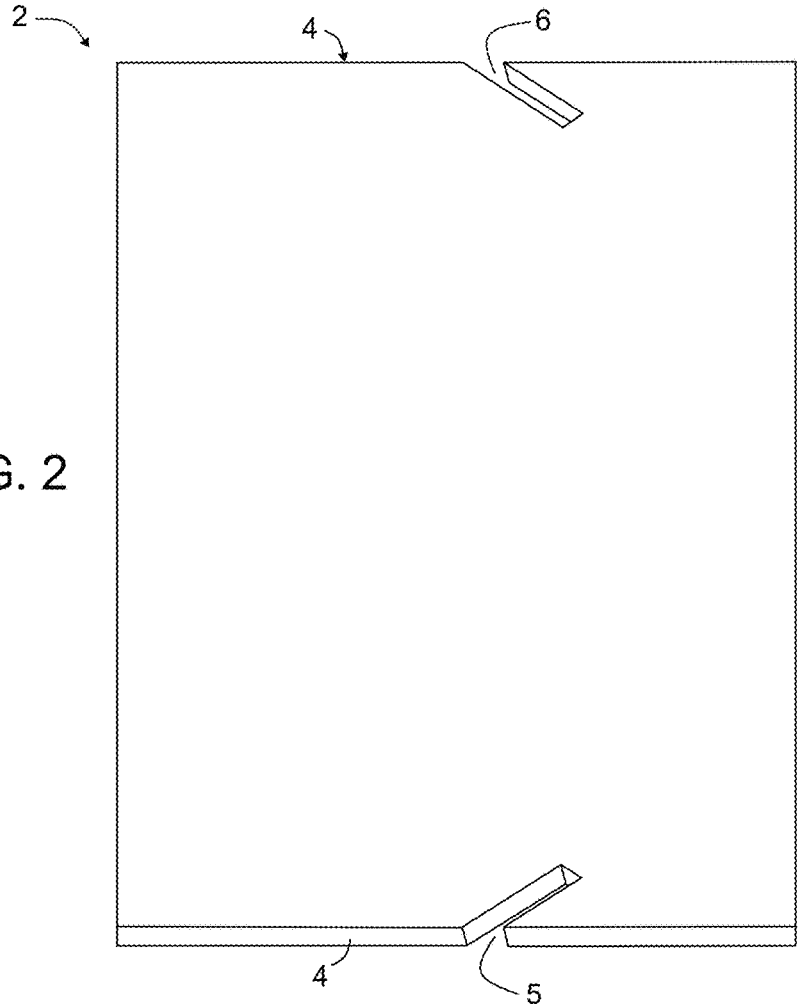
FIG. 2 is a top perspective view of a shelf in the FIG. 1, 1A embodiment showing a first compound angled slot at one end of the shelf and a second compound angled slot mirroring the first slot at the opposite end of the shelf.

As illustrated in FIG. 1A each inclined planar support leg 3 is rotated along its longitudinal axis at an angle oblique to the ends of the shelves. Correspondingly, as shown in FIG. 2, the shelf 2 includes angled slots 5 and 6, which mirror each other at the opposite ends 4 of the shelf, each slot being adapted in size, position and inclination for slidable engagement with the inclined and rotated support legs, forming a compound angular joint of the members.

Figure 3:
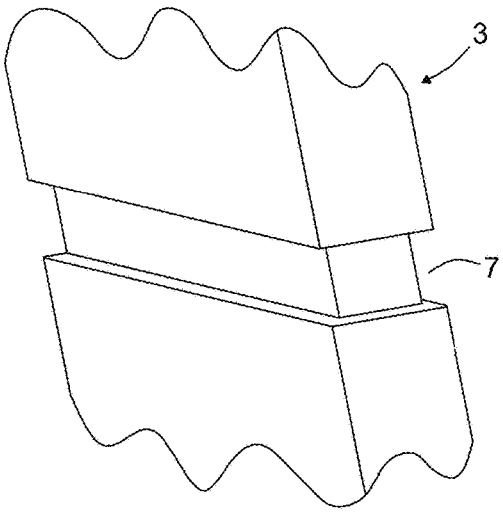
FIG. 3 is an enlarged fragmentary perspective view of a fitment comprised of a recess in the support member of the FIG. 1, 1A embodiment which engages with the compound angled slot of the shelf.
Figure 4:
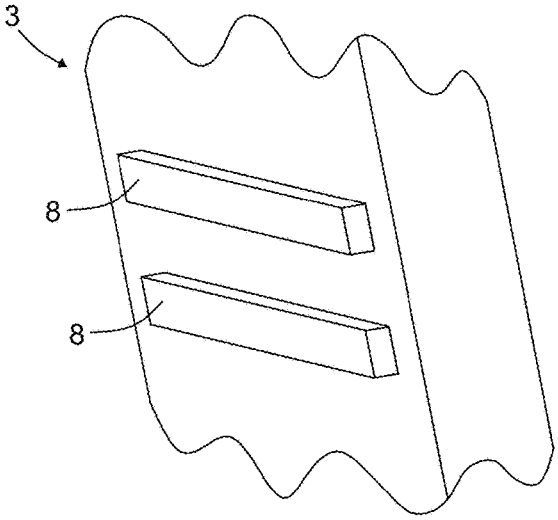
FIG. 4 is an enlarged fragmentary perspective view of an alternative fitment on the support member of the FIG. 1, 1A embodiment.

Coincidentally, fitments are included on the legs at desired levels to engage with the angled shelf slots and support the shelf horizontally at the desired level. FIG. 3 illustrates one such "subtractive" fitment comprised of a recess 7, which is adapted in size, position and inclination to facilitate slidable engagement with the angled shelf slot. FIG. 4 illustrates an alternative "additive" fitment 8 adapted in size, position and inclination to facilitate slidable engagement with the angled shelf slot.

Figure 5:
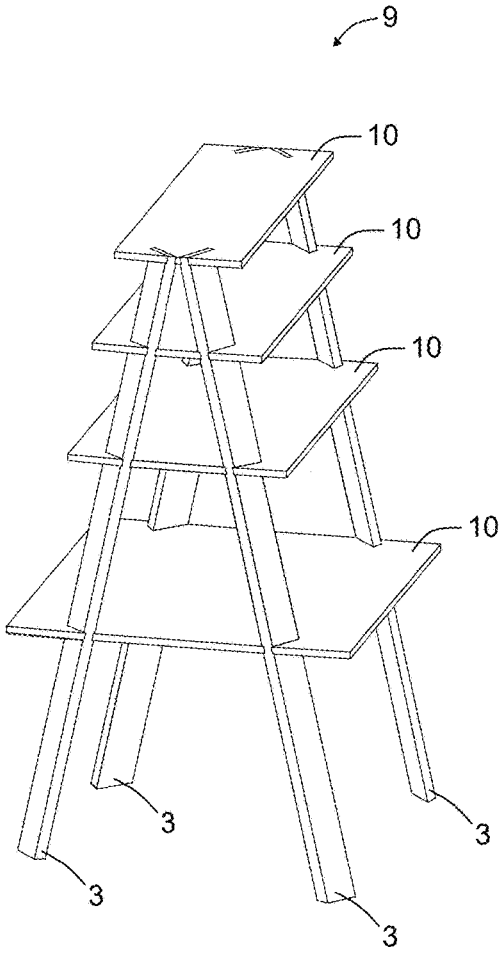
FIG. 5 is a perspective view of a second embodiment of the invention comprising a free-standing shelving structure with inclined obliquely rotated support members engaging the ends of the shelves.

FIG. 5 illustrates another embodiment of the present disclosure, a structure 9 such as a free-standing shelving structure. This shelving structure 9 includes the described characteristics of structure 1 of the FIG. 1, 1A embodiment, except that it includes a pair of inclined rotated support legs 3 at each end of the structure, engaged with a pair of corresponding angled slots at each end of the shelves 10, to form a four-legged free-standing structure. In all other aspects including composition of fitments, the geometry of the angled shelf slots, and the formation of compound angular joints of the shelf and leg members, the description of structure 1 is applicable to structure 9. Indeed, the structure 9 embodiment may be formed from two structure 1 embodiments back-to-back.

Figure 6:
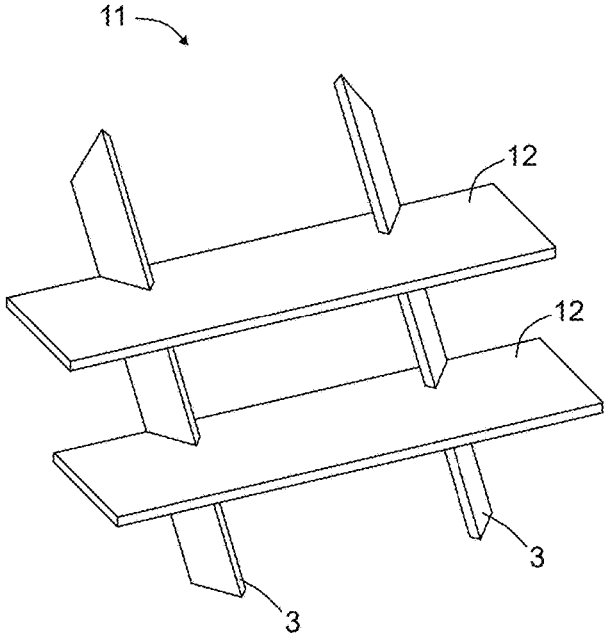
FIG. 6 is a perspective view of a third embodiment of the invention comprising a shelving structure with inclined obliquely rotated support members engaging slots extending inward from the rear edge of the shelves.

Another embodiment, illustrated in FIG. 6, is a structure 11 such as a shelf structure. This shelf structure 11 includes the described characteristics of structure 1 of the FIG. 1, 1A embodiment, except that the inclined rotated support legs 3 are at the rear of the structure, engaged with corresponding angled slots that extend inward from the rear edge of each shelf 12. In all other aspects including composition of fitments, the geometry of the angled shelf slots, and the formation of compound angular joints of the shelf and leg members, the description of structure 1 is applicable to structure 11.

It is contemplated that a structure embodying the present disclosure can be made with a variety of different finishes, and further that a variety of different materials can be used to make the component members of the structure, including wood, metal, glass, plastic, composite, and various combinations of the same.

Further, it is contemplated that the structure can be made with various material thicknesses, and at various heights, widths, depths, and angles of inclination. Following, it is also contemplated that the disclosure allows for fitments of different form and composition to facilitate the slidable engagement of the members in forming compound angular joints without fasteners.

Advantageously, the present disclosure includes surprisingly stable structures that can be leaned against another structure including a wall or configured into a free-standing structure to form benches, desks, tables and other articles of furniture. It is also conceived that the component members of the present embodiments can even be given sufficient strength and stability to form a stair or ladder structure if desired.

It is to be understood that variations and modifications can be made to the structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

The invention claimed is:

1. A structure comprising:

at least one horizontally disposed longitudinal planar member, said member including a front and rear edge, a top surface, a bottom surface, a first end, a second end, and having a first elongated slot extending inward obliquely from the first end thereof, and having a second elongated slot, mirroring the first elongated slot, said second slot extending inward obliquely from the second end thereof; and at least two spaced apart longitudinal planar support members, each of said first and second support members including an inclined front edge, a rear edge, opposing planar sides, a top end, and a base end, wherein each support member is rotated along the longitudinal axis at an angle oblique to the end of the horizontal member, and including at least one fitment at a desired level, said fitment adapted for corresponding engagement with the respective elongated obliquely angled slot of the horizontal member to support said horizontal member at the desired level, wherein said fitment being engaged with said respective slot to securely and rigidly position said rotated inclined support member at the end of said horizontal member in non-perpendicular relationship thereto only by interengagement.

2. The structure of claim 1, wherein the first elongated slot of the horizontal member includes parallel sides and a terminal face, all not perpendicular to the top and bottom surfaces of the horizontal member, and the second elongated slot, mirroring the first elongated slot, includes parallel sides and a terminal face, all not perpendicular to the top and bottom surfaces of the horizontal member, each said slot being adapted for corresponding engagement with the respective fitment of the inclined obliquely rotated support member.

3. The structure of claim 1, wherein each of the support member fitments is comprised of a recess in the front edge of said respective support member, said recess extending therealong at least one of the planar sides of the support member towards the rear edge at an angle not perpendicular to the front edge, said recess including parallel top and bottom surfaces not perpendicular to the planar sides of the support member, said recess being adapted for corresponding engagement with the respective elongated obliquely angled slot of the horizontal member to support said horizontal member at the desired level.

4. The structure of claim 1, wherein the base end of each of the longitudinal planar support members is correspondingly angled along its x and y axes, so that it rests flush to the floor in concert with the inclination and rotation of said support member.

5. The structure of claim 1, wherein the rear edges of a plurality of said horizontal members are vertically aligned.

6. The structure of claim 1, comprising a plurality of said horizontal members wherein the elongated slots of the first ends of the plurality of horizontal members are predisposed for simultaneous slidable engagement with the fitments of a first said inclined obliquely rotated support member, and the elongated slots of the second ends of the plurality of horizontal members are predisposed for simultaneous slidable engagement with the fitments of a second said inclined obliquely rotated support member.

7. A free-standing structure comprising:

at least one horizontally disposed longitudinal planar member, said member including a front and rear edge, a top surface, a bottom surface, a first end, a second end, and including at least two spaced apart elongated slots, each slot extending inward at an oblique angle from the first end thereof, and including at least two spaced apart elongated slots, each slot extending inward at an oblique angle from the second end thereof; and at least two spaced apart longitudinal planar support members at each end of the horizontal member, said support members including an inclined front edge, a rear edge, opposing planar sides, a top end, and a base end, wherein each member is rotated along the longitudinal axis at an angle oblique to the end of the horizontal member, and including at least one fitment at a desired level, said fitment adapted for corresponding engagement with the elongated obliquely angled slot of the horizontal member to support said horizontal member at the desired level.

8. The structure of claim 7, wherein the elongated obliquely angled slots of the horizontal member include parallel sides and a terminal face, all not perpendicular to the top and bottom surfaces of the horizontal member.

9. The structure of claim 7, wherein each of the support member fitments is comprised of a recess in the front edge of said respective support member, said recess extending therealong at least one of the planar sides of the support member towards the rear edge at an angle not perpendicular to the front edge, said recess including parallel top and bottom surfaces not perpendicular to the planar sides of the support member, said recess adapted for corresponding engagement with the respective elongated obliquely angled slot of the horizontal member to support said member at the desired level.

10. The structure of claim 7, wherein the base end of the respective longitudinal planar support member is correspondingly angled along its x and y axes, so that it rests flush to the floor in concert with the inclination and rotation of the support member.

11. A structure comprising:

at least one horizontally disposed longitudinal planar member, said member including a front and rear edge, a top surface, a bottom surface, a first end, a second end, and having a first elongated slot extending inward obliquely from the rear edge thereof, and having a spaced apart second elongated slot, said second slot extending inward obliquely from the rear edge thereof;

and at least two spaced apart longitudinal planar support members, said members including an inclined front edge, a rear edge, opposing planar sides, a top end, and a base end, wherein each support member is rotated along the longitudinal axis at an angle oblique to the rear edge of the horizontal member, and including at least one fitment at a desired level, said fitment adapted for corresponding engagement with the respective elongated slot of the horizontal member to support said horizontal member at the desired level.

12. The structure of claim 11, wherein the first elongated slot of the horizontal member extending inward obliquely from the rear edge thereof, has parallel sides and a terminal face, all not perpendicular to the top and bottom surfaces of the horizontal member, and the second elongated slot, mirroring the first elongated slot, has parallel sides and a terminal face, all not perpendicular to the top and bottom surfaces of the horizontal member.

13. The structure of claim 11, wherein each of the support member fitments is comprised of a recess in the front edge of said respective support member, said recess extending therealong at least one of the planar sides of the support member towards the rear edge at an angle not perpendicular to the front edge, said recess including parallel top and bottom surfaces not perpendicular to the planar sides of the support member, said recess adapted for corresponding engagement with the respective elongated obliquely angled slot of the horizontal member to support said member at the desired level.

14. The structure of claim 11, wherein the base end of the respective longitudinal planar support member is correspondingly angled along its x and y axes, so that it rests flush to the floor in concert with the inclination and rotation of the support member.

* * * * *